US005909907A

United States Patent [19]

Oetiker

[11] Patent Number: 5,909,907

[45] Date of Patent: Jun. 8, 1999

[54] MACHINE FOR AUTOMATICALLY MANUFACTURING PUZZLE-LOCK COMPRESSION RINGS

[75] Inventor: Hans Oetiker, Horgen, Switzerland

[73] Assignee: Hans Oetiker AG Maschinen - und Apparatefabrik, Horgen, Switzerland

[21] Appl. No.: 08/822,919

[22] Filed: Mar. 21, 1997

[51] Int. Cl.[6] ..... B23P 19/00; B21D 51/00

[52] U.S. Cl. ..... 29/33 R; 29/243.517; 72/398; 72/403

[58] Field of Search ..... 29/243.517, 283.5, 29/283, 282, 428, 33 R; 72/398, 403, 368, 402

[56] References Cited

U.S. PATENT DOCUMENTS

| | | | |
|---|---|---|---|
| 4,395,900 | 8/1983 | Saurenman | 29/428 X |
| 4,466,267 | 8/1984 | Casler et al. | 72/368 |

FOREIGN PATENT DOCUMENTS

| | | | |
|---|---|---|---|
| 6013659 | 8/1956 | Germany | 72/403 |
| 405123741 | 5/1993 | Japan | 72/398 |

*Primary Examiner*—William Briggs
*Attorney, Agent, or Firm*—Birch, Stewart, Kolasch & Birch, LLP

[57] ABSTRACT

A method and machine for manufacturing compression rings in which flat band material is fed to a stamping station from a feed station, a blank is stamped out with a mechanical connection having male and female configurations at opposite ends, the blank is then fed to a deformation machine where it is displaced into the several axial positions of the machine in which, in a first position, the blank is predeformed into configuration permitting closing of the mechanical connection in a second position in which the blank is also deformed into its circular configuration. Preferably the thus-deformed and closed compression ring is then subjected to a swaging action in a third position before it is ejected out of the machine.

30 Claims, 13 Drawing Sheets

1) STAMP OUT PUZZLE LOCK.
2) PARTIALLY PRESS TOGETHER AGAIN PUZZLE LOCK.
3) FEED OF BAND BY FLAT BLANK LENGTH.
4) RESEPARATE AGAIN BAND IN BENDING TOOL.
5) DISPLACE SEPARATED BAND BLANK TRANSVERSELY TO FEED DIRECTION TO FIRST POSITION IN BENDING MACHINE.

MACHINE FOR AUTOMATICALLY MANUFACTURING PUZZLE-LOCK COMPRESSION RINGS

FIELD OF THE INVENTION

This invention relates to a machine for automatically manufacturing compression rings with a mechanical connection, preferably of the puzzle-lock type.

BACKGROUND OF THE INVENTION

Shrinkable compression rings are known in the art which, for the most part, have been made by cutting off rings from tubular stock of various materials. These rings were compressed or shrunk by various means, such as mechanical means, magnetic means, hydraulic means, etc.

The use of such compression rings has recently gained importance by the availability of so-called puzzle-lock clamping or compression rings made from band material, i.e., compression rings with a mechanical connection of the free ends thereof resembling a puzzle-lock as disclosed in my prior U.S. Pat. Nos. 5,001,816 and 5,185,908 which permitted the use of flat band material for the manufacture of such compression rings. However, to satisfy markets such as the automotive industry, it is necessary to provide machines capable of automatically mass-producing these so-called puzzle-lock compression rings.

SUMMARY OF THE INVENTION

Accordingly, it is a principal object of this invention to provide a machine which completely automatically manufactures from flat band material compression rings that have a mechanical connection. To be successful, such machines must be able to assure reliable high-speed mass-production to provide such compression rings in large quantities at reasonable price. Additionally, such machines must be able to be capable of being readily refitted to manufacture compression rings of different diametric sizes.

In one embodiment according to this invention, a feed station continuously feeds the flat band from a reel to a stamping station where one end portion of a blank with a mechanical connection, preferably of the puzzle-lock type, is stamped out so that each blank requires two successive cuts which then form cuts of complementary puzzle-lock configuration at opposite ends of the blank. The blank is thereupon fed to the deformation station where the flat blank is moved transversely to its feed direction into the bending machine, properly speaking. The bending machine has three successive positions in the transverse or axial direction of its core member about which the flat blank is deformed, and includes a number of slide members which are mechanically driven from cams. In a first position, the flat blank is predeformed into a shape approximating the shape of the finished compression ring with the free end portions of the blank predeformed accurately into a shape necessary to permit closing of the mechanical connection at the free end potions of the blank in the second position. The closed compression ring, now exhibiting its predetermined diametric dimension, is then subjected in a third position to a swaging operation to improve the locking action and holding ability of the mechanical connection against inadvertent reopening during transport and/or during subsequent use. Upon completion of the various operating steps, the completed compression ring is then ejected. At the stamping station the stamping die preferably produces a cut resembling a puzzle lock when severing adjacent band portion.

However, the stamping die is so constructed that the mutually facing male and female ends resulting from a stamping operation are again partly reconnected after initial complete separation in order to permit continuation of the feed of two or more successive blanks, each of which requires two cuts spaced in the longitudinal direction as a function of the compression ring size. Furthermore, the speed of the continuous feed from the reel to the stamping station and the speed of the intermittent feed from the stamping station to the bending or deforming station are so correlated, preferably with the use of a slack between the reel and the stamping station that the continuous and intermittent feed are properly coordinated to feed the same length of band material within a given cycle of operation. Additionally, the machine preferably includes a straightening device of conventional construction including, for example, pressure rollers arranged staggered and in two rows to remove any curls, kinks or bends from the band resulting from the reeling operation before the band reaches the stamping station. An oiling device of any conventional construction just ahead of the stamping die assures sufficient lubrication of both sides of the band as required by the stamping die before the band reaches the stamping station.

The method according to this invention includes the steps of feeding from a reel a flat band material to a stamping station where the mechanical connection, preferably of puzzle-lock configuration, is stamped-out, partly reconnecting the previously disconnected mutually facing portions of a mechanical connection, feeding the thus partially reconnected flat blank to the bending or deformation station, again completely separating at the bending station the leading blank from its next-following blank, moving the thus-separated blank into the bending or deforming station in a direction transverse to the feed direction and deforming and completing the compression ring with its mechanical connection in several stages, one disposed behind the other in the transverse direction.

BRIEF DESCRIPTION OF THE DRAWING

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figures 1A, 1B:
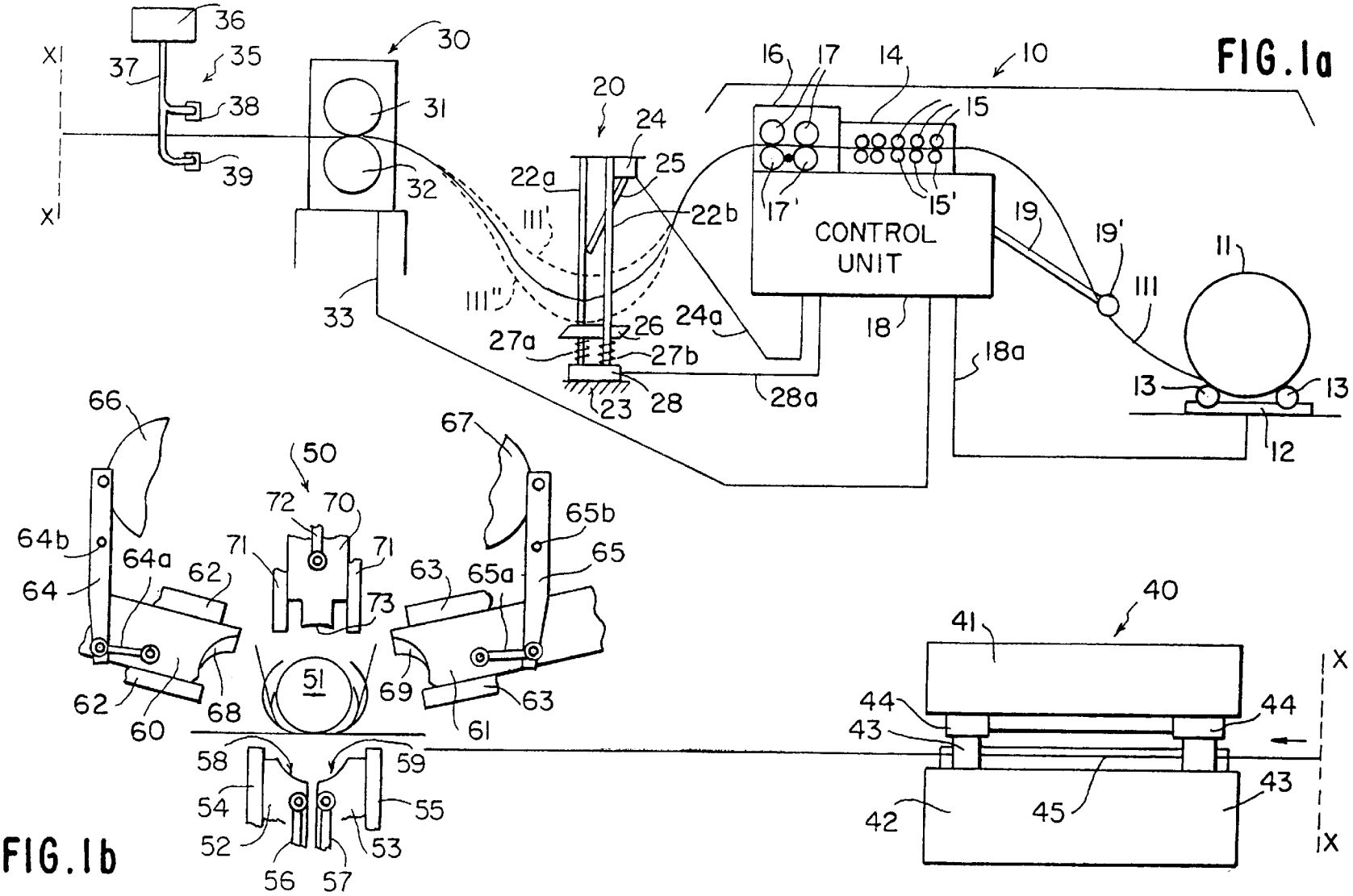
FIGS. 1*a* and 1*b* are schematic views of one embodiment of the machine in accordance with the present invention.

Referring now to the drawing wherein like reference numerals are used throughout the various views to designate like parts and more particularly to FIGS. 1*a* and 1*b*, reference numeral 10 generally designates the feed station for the continuous feed of the band which includes a reel 11 with band material coiled thereon. The reel 11 is rotated by a drive mechanism 12 including drive rollers 13. A straightener unit 14 includes upper pressure rollers 15 and lower pressure rollers 15', preferably arranged staggered to one another, which are intended to remove any curls, kinks or bends in the band that may have occurred during coiling of the band on the reel 11. Following the straightener unit 14 is a feed unit 16 providing a continuous feed of the band 111 and including upper feed rollers 17 and lower feed rollers 17' of conventional construction. A control unit 18 of conventional construction electronically controls the operation of the various parts of the machine. The speed of the roller members 13 is thereby controlled by a lever arm 19 having a follower member 19' riding on the band 111 and connected with a potentiometer so as to control the speed of the roller members 13 by way of line 18*a*. A slack control unit generally designated by reference numeral 20, schematically shown in the drawing, controls the maximum and minimum slack 111" and 111' in the band, necessitated by the use of a continuous feed in the feed station 10 as contrasted to the intermittent feed of the band required for the stamping operation in the stamping station 40 to enable stamping of the puzzle lock during standstill of the band. The slack control unit 20 may be of any conventional construction and may include, for example, two upright members 22*a* and 22*b* interconnected at the top and fixedly secured at the bottom at 23. A limit switch 24 is thereby connected to the upper part of the upright member 22*b* whose switch mechanism is actuated by a downwardly extending probe member 25 adapted to engage with the slack when the slack 111' reaches its predetermined minimum slack to actuate the switch in switch mechanism 24 and feed the information to the control unit 18 by way of line 24*a* to speed up the continuous feed. The maximum predetermined slack also is sensed by a limit switch, for example, by a metallic plate member 26 insulated with respect to ground and mounted in predetermined position, preferably adjustably on upright members 22*a* and 22*b*, whereby wires 27*a* and 27*b* are mounted over the upright members 22*a* and 22*b*. The band 111 is normally electrically grounded by any conventional means so that with a slack 111" exceeding the maximum intended slack, it will apply ground to the plate member 26, previously insulated with respect to ground, whereby grounding of the plate member 26 is applied to the control unit by way of connector 28 and line 28*a* causing the continuous feed to slow down. The information fed to the control unit 18 by way of lines 24*a* and 28*a* is thus used to control the speed of the feed station 10, 11, 12, 13, 15 and 16 by slowly varying the speed thereof to keep the slack between predetermined limits. Of course, any other known arrangement may also be used to perform the limit functions of 25, 24, 24*a* and of 26, 28, 28*a*. An intermittent feed unit generally designated by reference numeral 30 provides intermittent feed of the band 111 to the stamping unit generally designated by reference numeral 40 by way of an oiling device generally designated by reference numeral 35 which lubricates the upper and lower surface of the band from a reservoir 36 by way of line 37 and branch lines 38 and 39 as required by the stamping die. The oiling device 35 is thereby located as close to the stamping unit 40 as possible. The stamping unit 40 includes a ram member 41 and a fixed base member 42 which fixedly supports upright, column-like guide members 43 about which the ram member 41 is reciprocably supported by means of the short support members 44 integral with the ram member 41. The stamping die (not shown) is contained within a two-partite housing 45 that contains the stamping die, properly speaking (not shown), to obtain a mechanical connection, preferably of the puzzle-lock type. The stamping die consists of four parts, two lower matrix-like members and two upper punching members which are actuated by the ram member 41 in any conventional manner. The trailing lower matrix-like member, as viewed in the feed direction of the band, is thereby not supported directly on the fixed base member 42 but rather spring-supported by strong springs while the leading lower matrix-like member is supported directly on the fixed base member 42 and the leading upper punching die member is also spring-supported for reasons that will be explained hereinafter in connection with the stamping operation which requires a partial reconnection of successive blanks for the further feed of the stamped-out band material from the stamping station to the deformation station, properly speaking, and generally designated by reference numeral 50.

The bending or deformation station 50, properly speaking, has three axial positions in a direction transverse to the feed direction of the band from the stamping station 40 to the deformation station 50. The blank with a mechanical connection, preferably of male and female puzzle-lock configurations at the leading and trailing end portions, respectively, is deformed about the core member 51 by means of lower vertically reciprocable slide members 52 and 53, lateral slide members 60 and 61 adapted to reciprocate in a lateral slightly downwardly inclined direction, and by an upper vertically reciprocable slide member 70. Each slide member 52, 53, 60, 61 and 70 is thereby composed of as many axially arranged sections rigidly interconnected with one another in a given slide member, as required by the number of axial positions in the deformation machine and the deforming surfaces thereof. The lower slide member 52 is guided within guide members 54 while the lower slide member 53 is guided within guide members 55, whereby guide members are provided on both sides of each slide member 52 and 53, but for convenience sake, only one is shown in some of the figures. The slide members 52 and 53 are thereby reciprocated by connecting rods 56 and 57 (FIG. 1*b*) connected to cam followers which follow appropriate cam surfaces of cam members, all of which are mechanically driven synchronously in the machine. Similarly, the slide members 60 and 61 are actuated by pivotal actuating members 64 and 65 whose lower ends are connected to the slide members 60 and 61 by connecting rods 64*a* and 65*a* and whose upper ends are provided with cam followers which follow the cam surfaces of mechanically driven cams 66 and 67. Each actuating member 64 and 65 is thereby pivotal about the pivot point 64*b* and 65*b*. The upper slide member 70 is actuated in its reciprocating movement by an actuating member 72 which is operatively connected by means of a cam follower to a mechanically driven cam (not shown).

Figure 5:
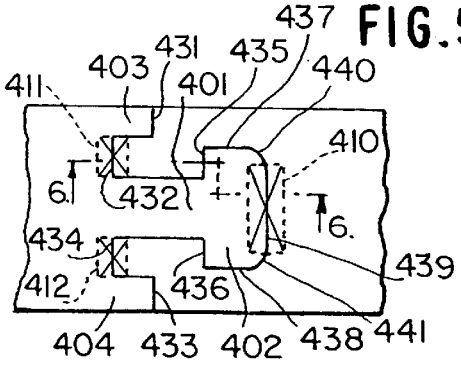
FIG. 5 is a plan view on one embodiment of a mechanical connection having a configuration resembling a puzzle-lock.
Figure 7:
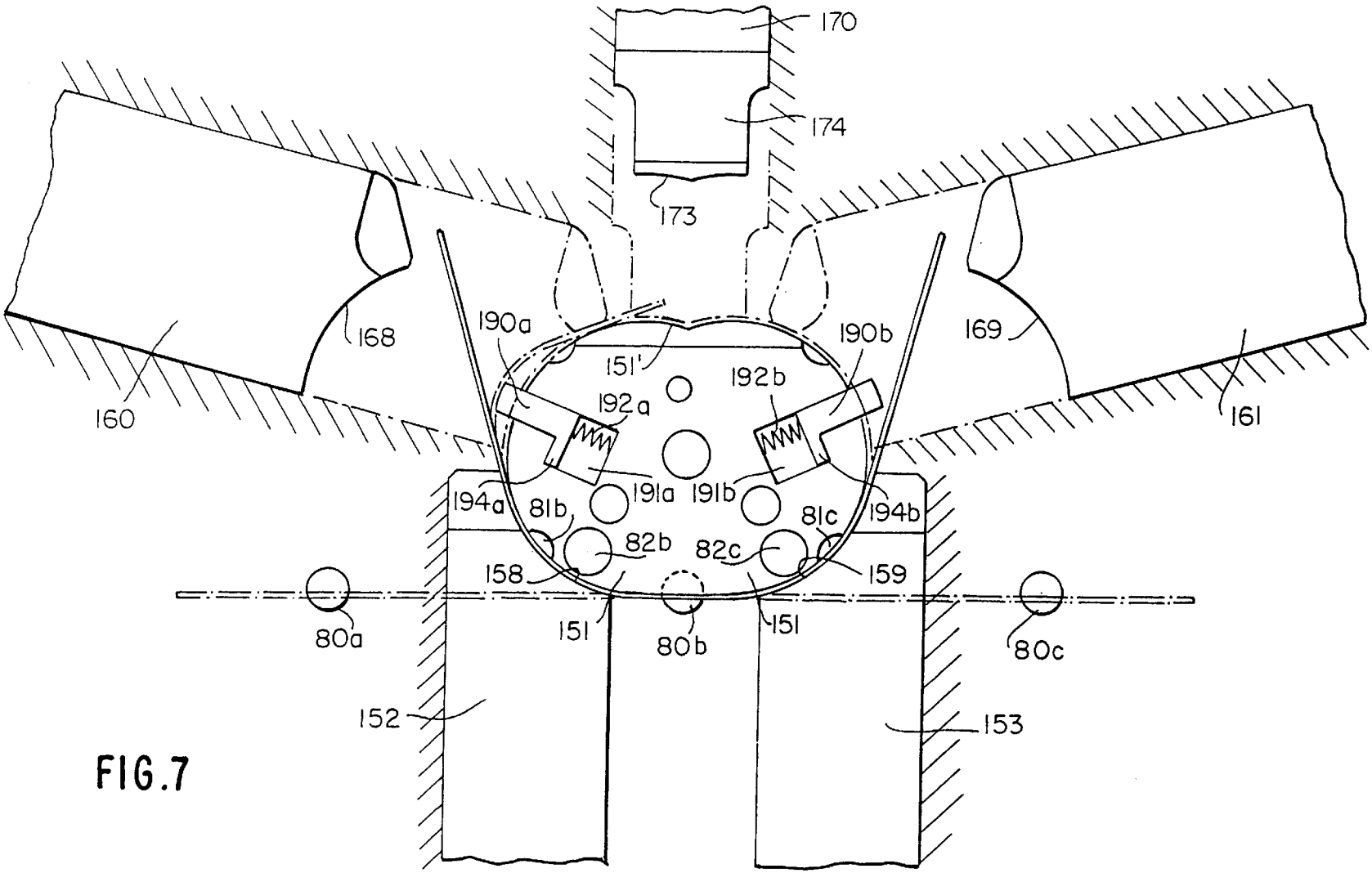
FIG. 7 is a somewhat schematic axial elevational view showing the configuration of the section of the core member and of the slide members and their deforming surfaces in position 1 of the deformation machine.

The mechanical connection of the compression rings may be of any known type, e.g., are of the puzzle-lock configuration, as described in my U.S. Pat. Nos. 5,001,816 and 5,185,908 but is preferably of an improved type of puzzle lock configuration as more fully disclosed also in my copending provisional application entitled "Improved Puzzle-Lock Compression Ring", filed on Apr. 17, 1996, under Ser. No. 60/015,700 (D/21569), the subject matter of which is hereby incorporated in its entirety into this application. The male portion generally designated by reference numeral 400 (FIGS. 3B, 3C and 3D) of such a mechanical the puzzle-lock-type connection includes a tongue portion 401 (FIG. 5) terminating in an enlarged head portion 402 and is provided with lateral lug portions 403 and 404. The female portion of such a mechanical puzzle-lock-type connection, generally designated by reference numeral 420 (FIGS. 3B, 3C and 3D) is of complementary shape to the male portion 400. Whereas substantially right angles are preferred in the various corners to provide transversely extending abutment surfaces 431, 432, 433, 434, 435 and 436, the lateral abutment surfaces 437 and 438 in the area of the enlarged head portion 402 pass over into the transversely extending abutment end surface 439 by way of rounded-off abutment surfaces 440 and 441 which greatly improves the holding ability of the mechanical connection as more fully explained in the aforementioned copending application. Additionally, the areas 410, 411 and 412 indicated in dash lines are subjected to a swaging action displacing material in the area of the joints of the transversely extending mutually engaging abutment surfaces 432, 434 and 439 to improve the holding action of the mechanical connection of the compression ring during transportation and/or use thereof to fasten, for example, hoses, axle boots or the like on nipples, axle stubs, etc.

The remaining details of the machine will be described in connection with the operation of the machine. One cycle of such operation thereby involves the intermittent feeding of band material to the stamping station 40 and out of the stamping station to the deformation station, whereby the stamping-out of the mechanical connection with a preferable puzzle-lock configuration takes place while the intermittent feed is at standstill and includes the severing and partial reconnection of adjoining male and female parts of the mechanical puzzle-lock-type connection, and the cyclical movement of the slide members 50, 52, 53, 60, 62 and 70 as will be explained hereinafter in further detail. It should be further noted, however, that the manufacture of the compression ring in the bending or deformation machine requires as many sequential cycles of operation as there are stages, i.e., positions in the axial direction of the core member 50. While the slide members have been designated in the schematic showing of FIG. 1*b* by reference numerals 52, 53, 60, 61 and 70, each such slide member consists of a number of axially arranged, rigidly interconnected sections corresponding to the number of positions along the axial direction of the core member 51 with a corresponding number of different deforming surfaces. To facilitate an understanding of the operation of the machine, parts of the core member and slide members corresponding to the first, second and third positions have been designated in FIGS. 7, 8, 9, 10, 11 and 12 by corresponding reference numerals of the 100, 200 and 300 series.

OPERATION

The operation of the machine according to this invention is as follows.

Band material 111 is continuously fed from the feed station 10 by decoiling the same from the reel 11, actuated by the drive mechanism 12 and the roller members 13 at a continuous speed controlled by the control unit 18 whereby the continuous speed in turn is determined by the position of the lever arm 19 riding with its follower member 19' on the band material 111 and connected to a potentiometer. As the electronic circuits of the control unit 18 are of conventional type, known to those skilled in the art and forming no part of this invention, a detailed description is dispensed with herein. The band material 111 continuously decoiled from the reel 11 is fed to the straightener unit 14 in which any kinks, curls or bends are removed to assure that the band material fed to the continuous feed unit 16 is completely flat. Feed rollers 17 and 17' of the feed unit 16 provide a continuous feed of the band material 111. The slack control unit 20 which senses the maximum slack 111" by means of plate member 26 and the minimum slack 111' by means of follower member 25, feeds back information to the control unit 18 by way of lines 24*a* and 28*a* when the minimum or maximum slack of the band material exceeds predetermined limits. This slack control is necessary to correlate the speed of the continuous feed unit 16 to the speed of the intermittent feed unit 30 in order that the length of band material fed per cycle is the same. This means that the speed of the feed rollers 31 and 32 controlled from the control unit 18 by way of line 33 must be greater than the speed of the continuously operating feed rollers 17 and 17' to compensate for the standstill during the stamping operation. An oiling device generally designated by reference numeral 35, which should be located as close to the stamping unit 40 as possible, includes a reservoir tank 36 for feeding lubricating oil by way of line 37 and branch lines 38 and 39 to the top and bottom of the intermittently fed band material, in an amount as required by the stamping die.

Figure 2A:
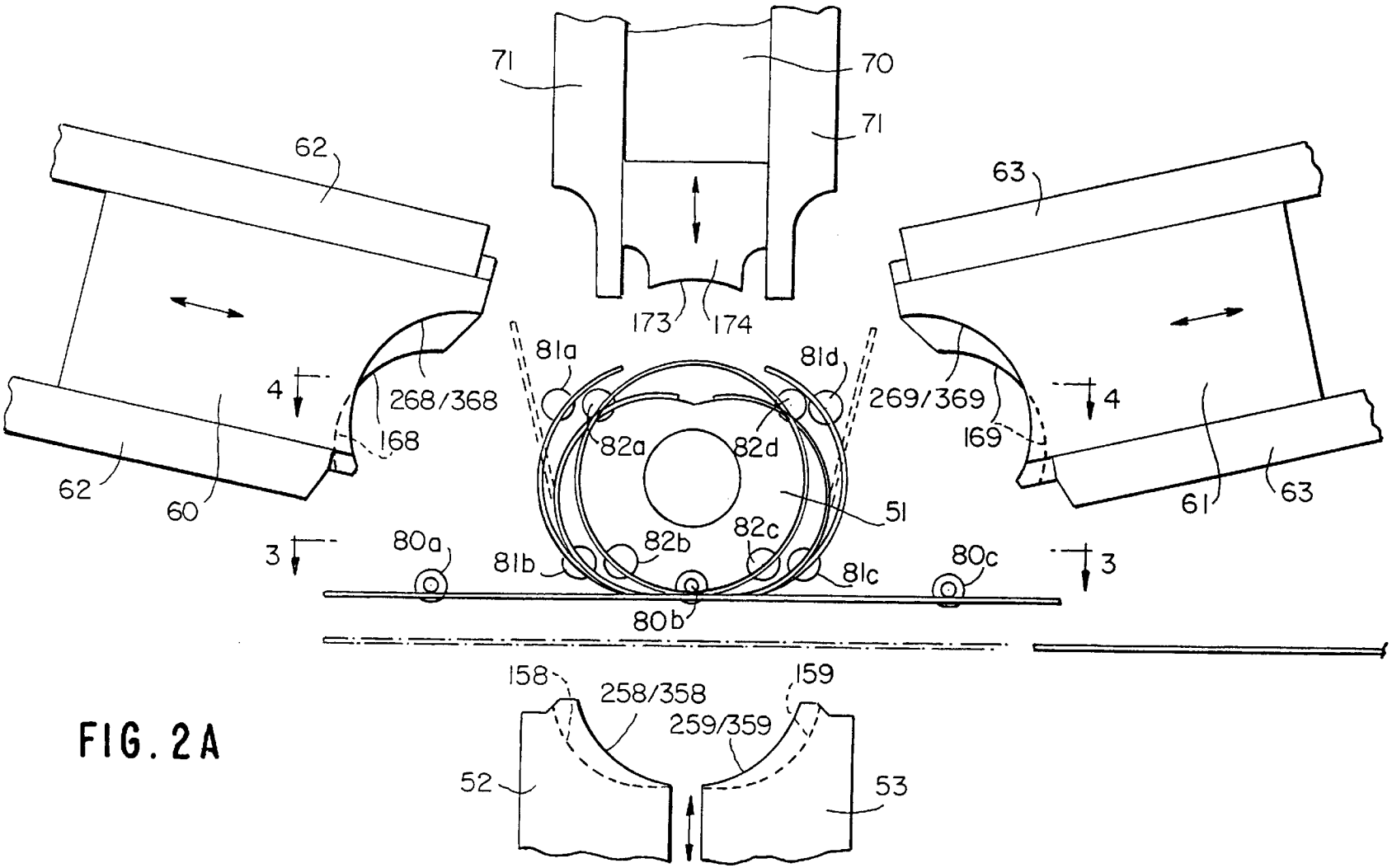
FIG. 2A is a somewhat schematic front elevational view of the various parts of the bending or deformation station with all slide members in the retracted position.
Figure 2B:
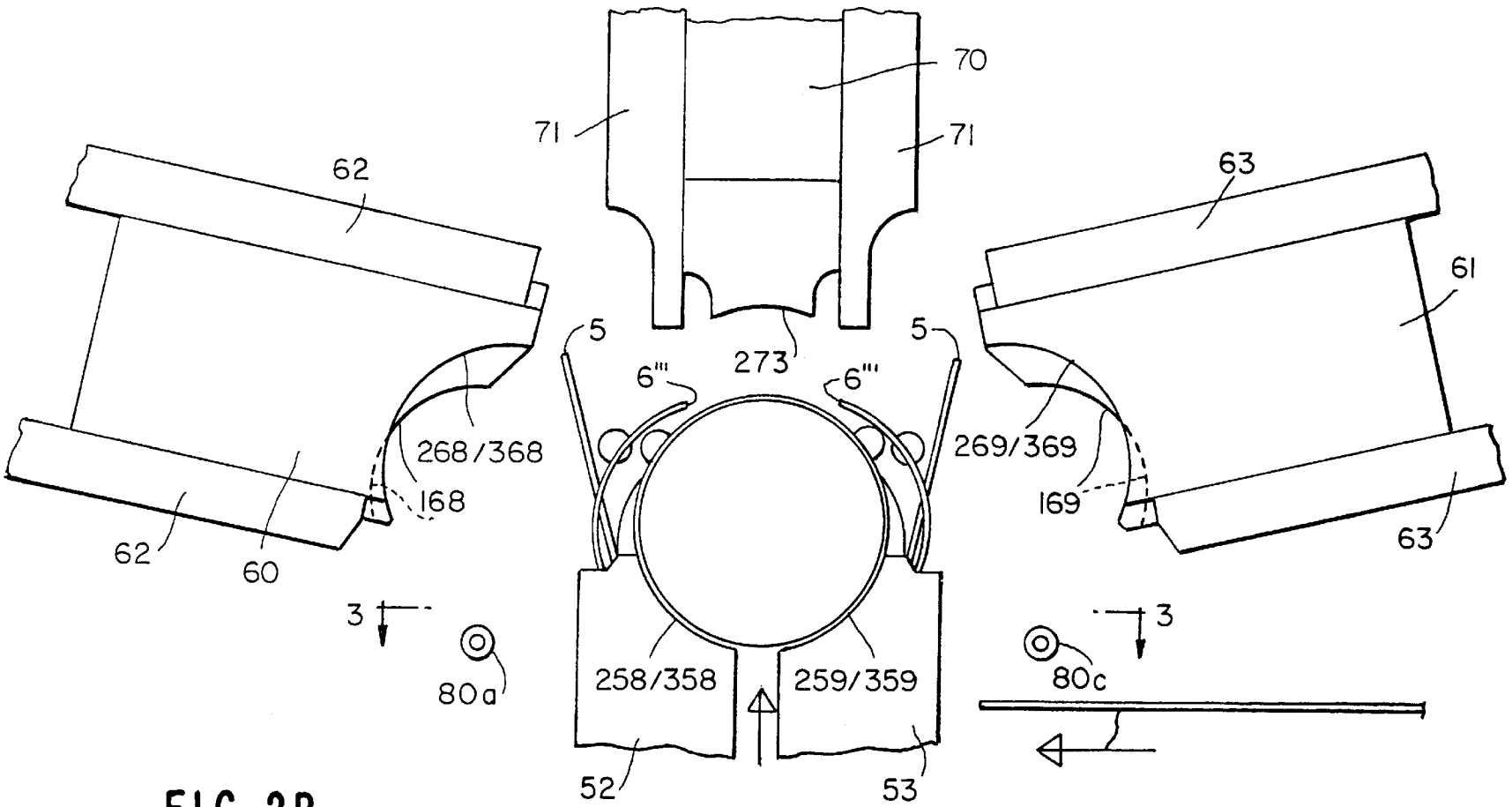
FIG. 2B is a front elevational view, similar to FIG. 2A, with the lower slide members in their upwardly extended position.
Figure 2C:
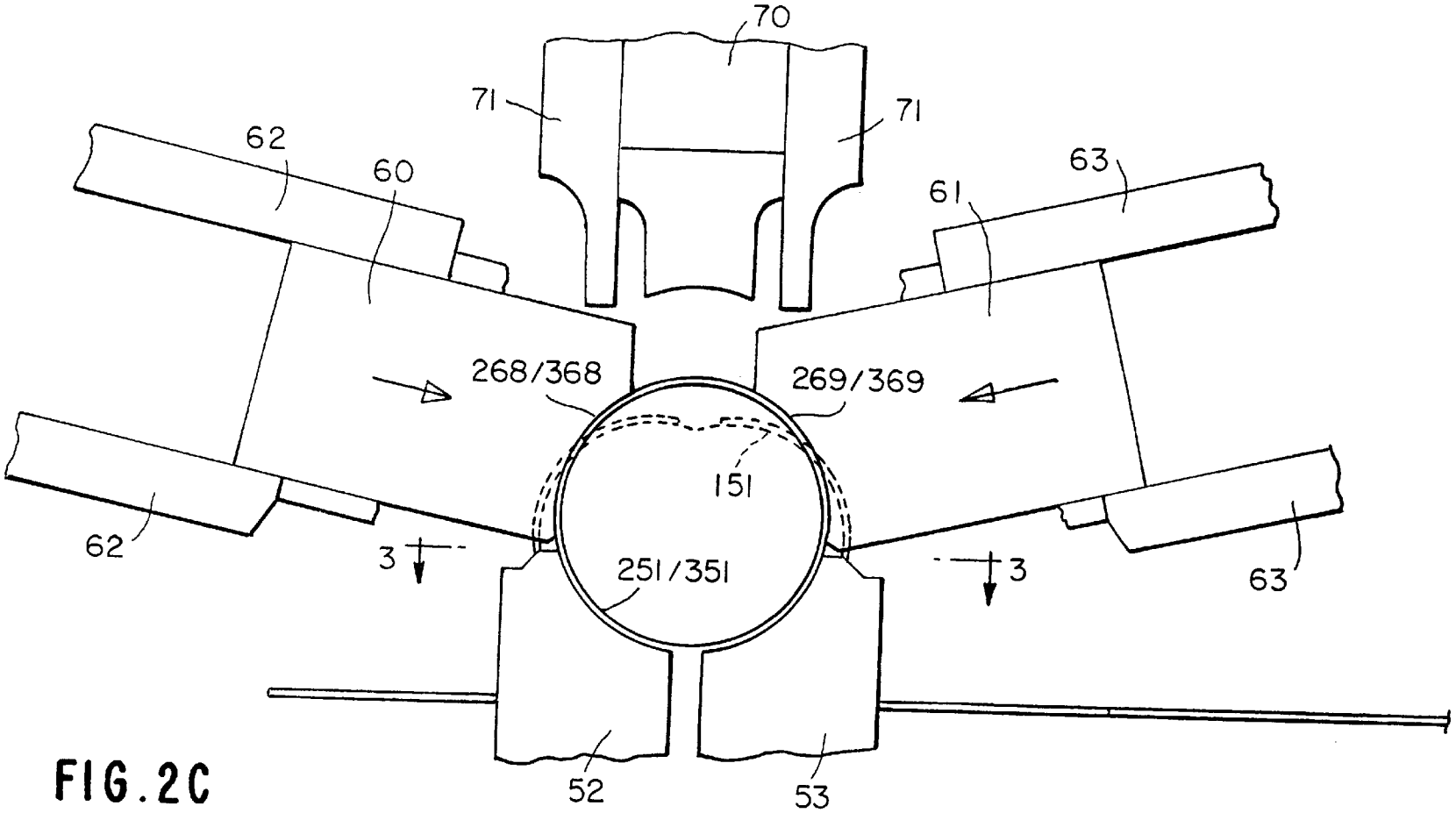
FIG. 2C is an elevational view, similar to FIG. 2B, with the lateral slide members in their extended position.
Figure 2D:
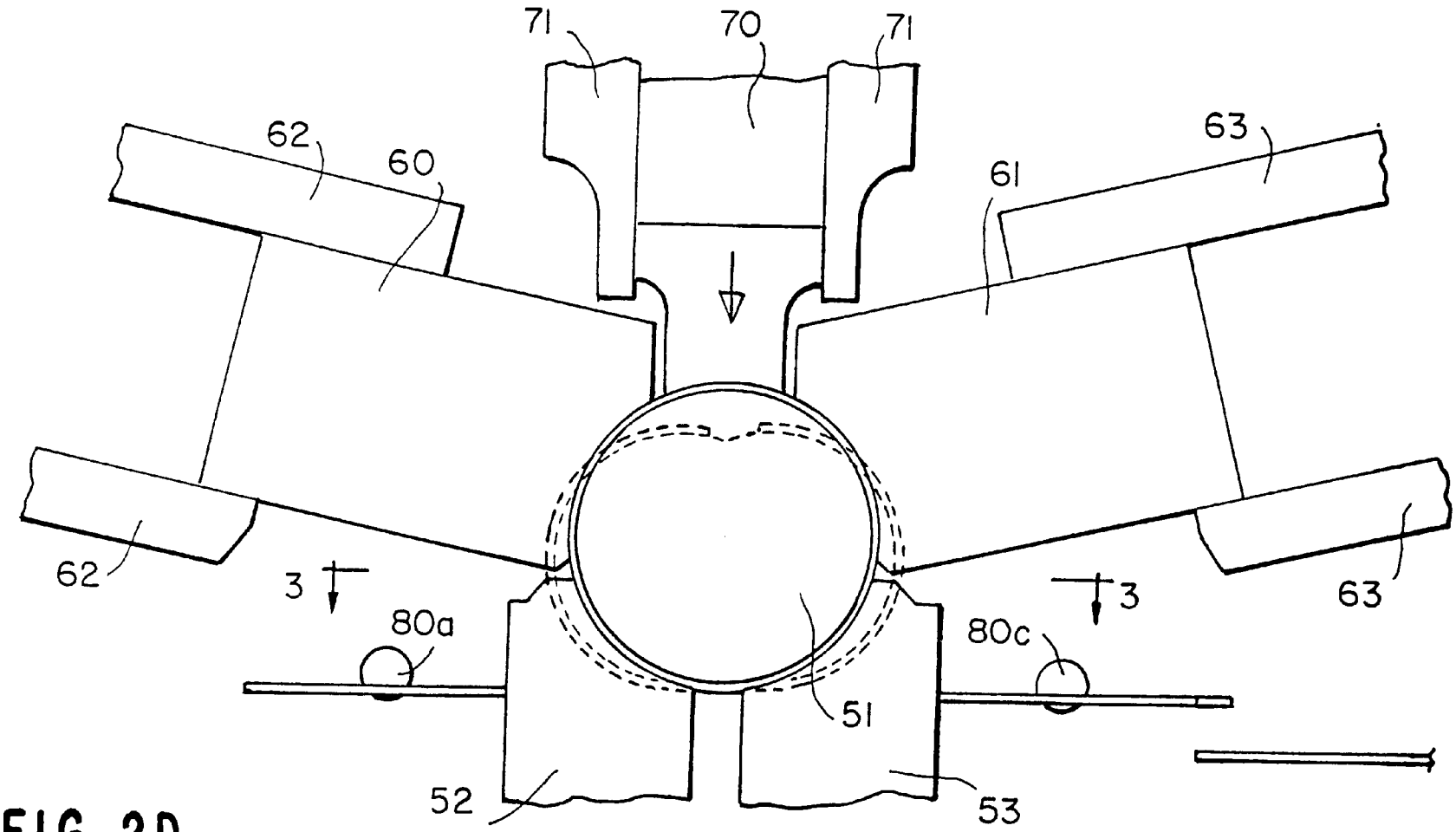
FIG. 2D is an elevational view, similar to FIG. 2C, with the upper slide member in the downwardly extended position.
Figure 3A:
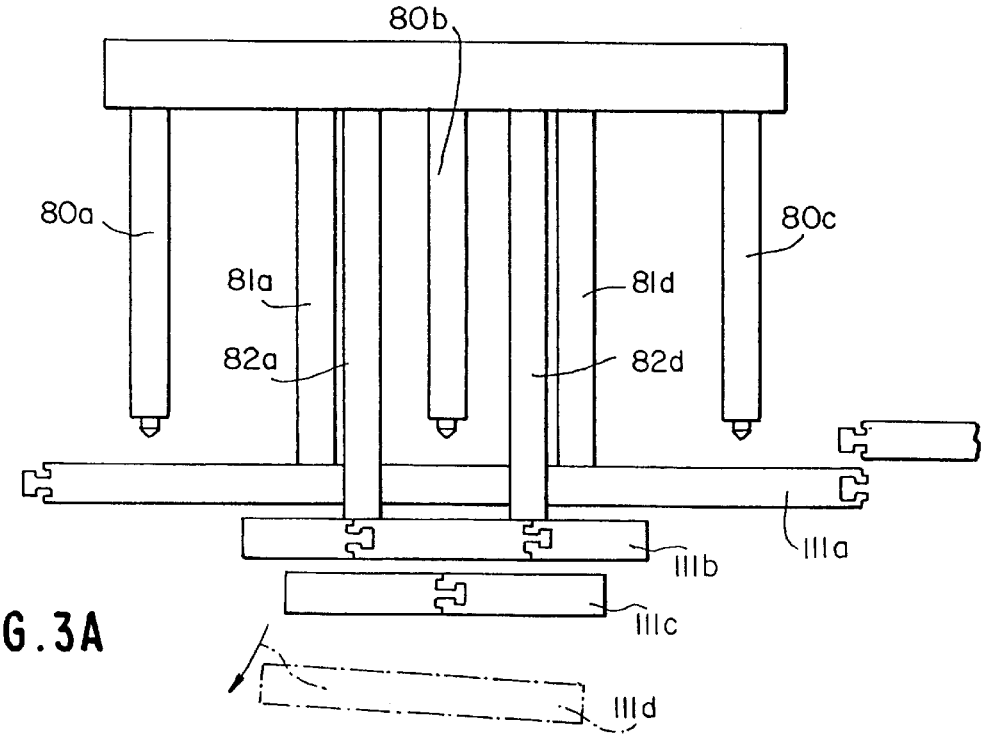
FIG. 3A is a cross-sectional view, taken along line 3—3 of FIG. 2A.
Figure 4A:
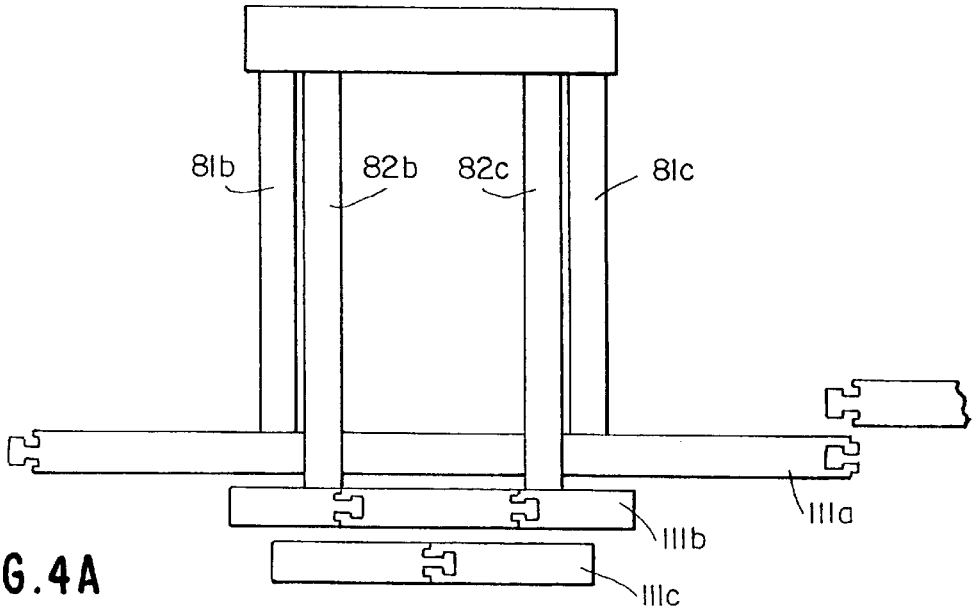
FIG. 4A is a cross-sectional view, taken along line 4—4 of FIG. 2A.
Figure 3B:
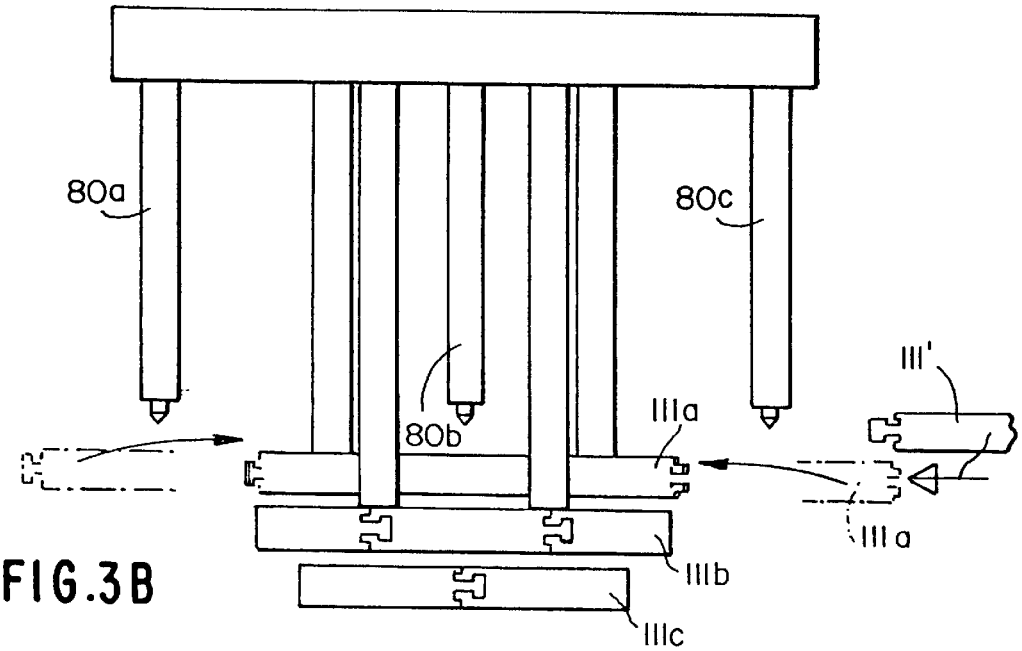
FIG. 3B is a cross-sectional view, taken along line 3—3 of FIG. 2B.
Figure 3C:
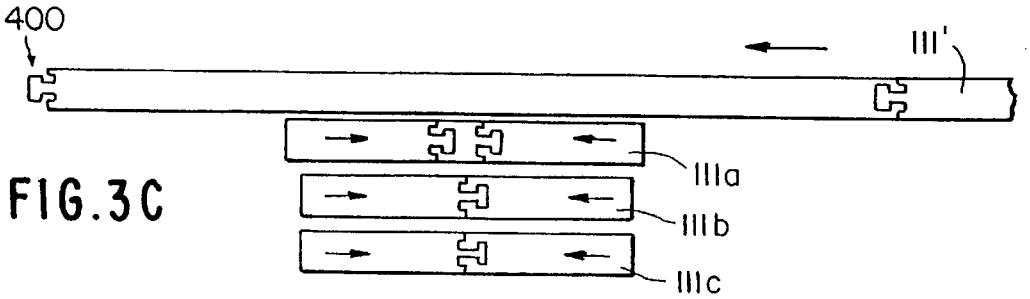
FIG. 3C is a cross-sectional view, taken along line 3—3 of FIG. 2C.
Figure 3D:
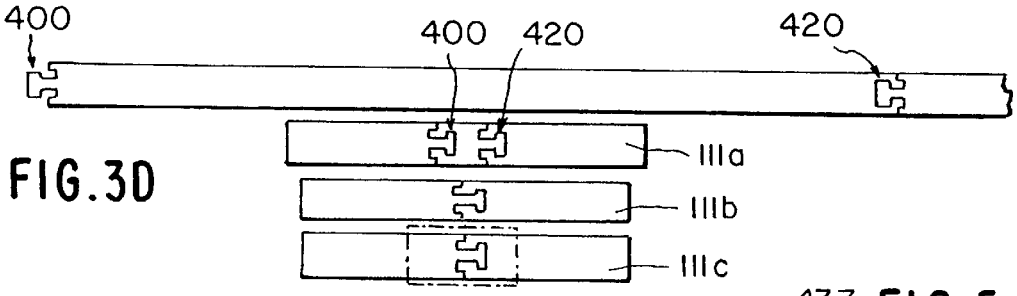
FIG. 3D is a cross-sectional view, taken along line 3—3 of FIG. 2D.
Figure 6:
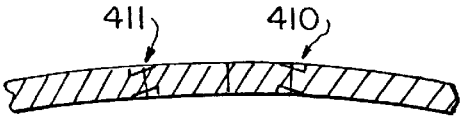
FIG. 6 is a cross-sectional view, taken along line 6—6 of FIG. 5.
Figure 14:
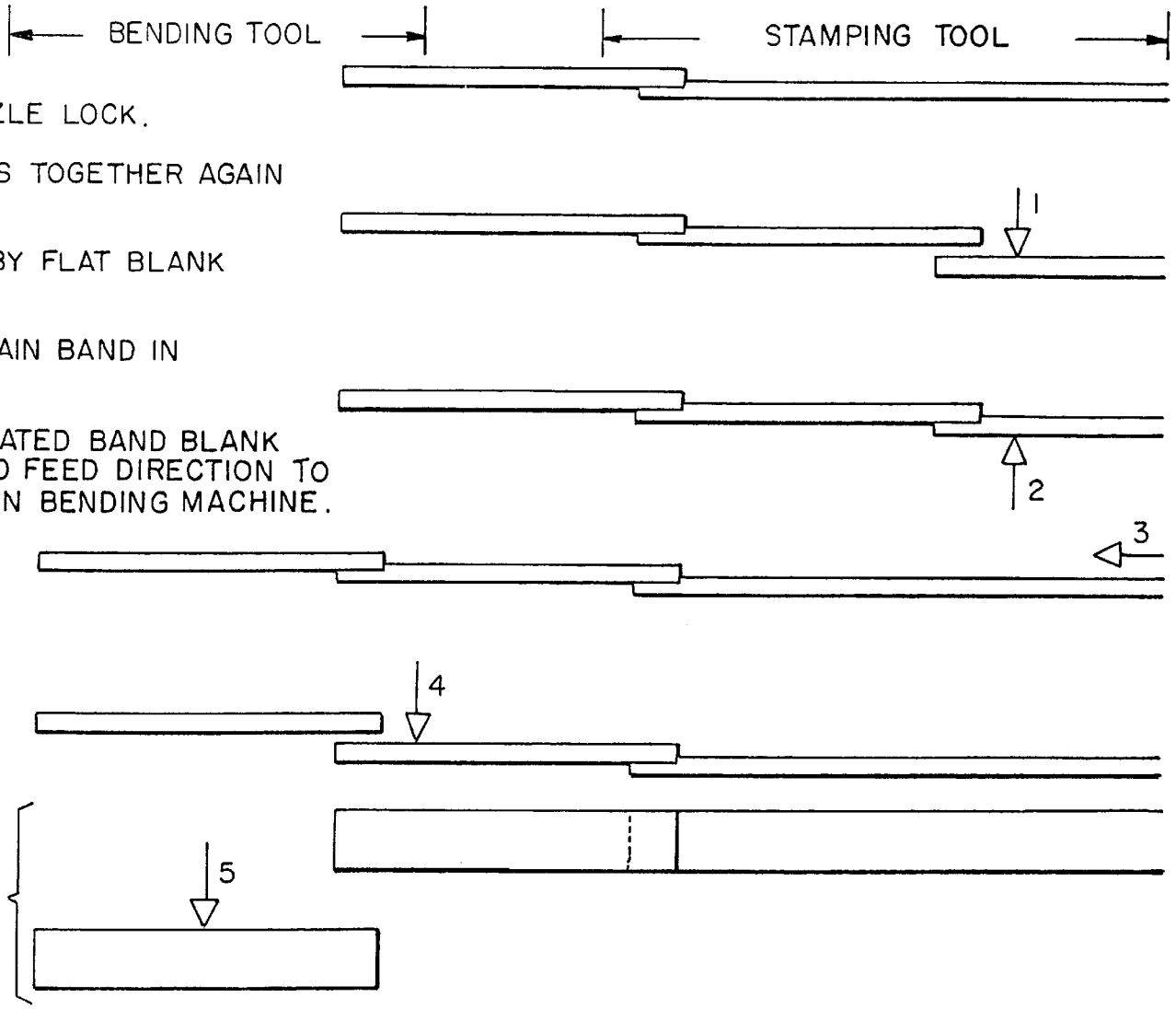
FIG. 14 is a schematic view of the stamping operation of the band material and of the partial reconnection of the severed parts.

The stamping unit 40 includes a reciprocating ram member 41, reciprocating on upright post-like guide members 43 by means of its shorter members 44, as is conventional in connection with such stamping units. The stamping unit 40 further includes a fixed base member 42 on which are supported the upright guide members 43. A two-partite housing 45 fixedly supported on base member 42 contains the stamping die, properly speaking (not shown), to realize the cuts for the mechanical connection, preferably of the puzzle-lock type. Each cut of a stamping operation of such a mechanical connection thereby provides a female puzzle-lock configuration in the trailing piece of band material and a male puzzle-lock configuration in the leading piece of band material. In order to be able to move blanks cut in the stamping station from the stamping station 40 to the bending or deformation station 50 by means of the intermittently operable feed unit 30, it is necessary to reconnect again two successive pieces of band material severed by the stamping operation during standstill in a given cycle of operation. For that reason, the stamping die consists of two lower matrix-like parts (not shown) and two upper punching die members (not shown) cooperating with a respective lower matrix member. The lower trailing matrix-like member, as viewed in the feed direction, is thereby spring-supported by a strong spring or springs while the leading upper punching die member of the leading pair is also spring-supported. The upper punching die member of the trailing pair is thereby operatively connected directly with the ram member 41 while the lower matrix-like member of the leading pair is supported directly on the base member 42. In this way, a partial reconnection of the severed puzzle-lock configurations obtained by a cut during standstill in one stamping cycle will again be partially reconnected as illustrated schematically in FIG. 14. The partial pressing together of the puzzle lock is thereby illustrated in step 2. of FIG. 14 which is brought about by the strong spring action supporting the lower matrix member of the trailing pair. FIG. 14 further illustrates at step 4. the reseparation at the deformation station of the leading blank from the trailing blank which had been partially reconnected at step 2. For that purpose, a spring-loaded plunger or pin member initially presses down in the deformation station on the next-following trailing blank during standstill of the intermittent feed, and complete reseparation is then realized by a plunger or pin member acting on the puzzle-lock male configuration of the next-following blank which is then held down separated by the spring-loaded plunger or pin member until the thus-separated leading blank now designated by reference numeral 111*a* has been moved transversely to the feed direction by finger-like members 80*a*, 80*b*, 80*c* as shown in FIGS. 2A and 3A. It should be noted that FIGS. 1*a*, 1*b*, 2A, 2B, 2C and 2D are side elevational views, taken in the axial direction of core member 51, while FIGS. 3A, 3B, 3C, 3D and 4A are schematic plan views, whereby the position of the various parts always correspond in FIGS. 2A, 3A and 4A, in FIGS. 2B and 3B, in FIGS. 2C and 3C and in FIGS. 2D and 3D. The blank is thereby designated by reference numerals 111*a*, 111*b* and 111*c* in the first, second and third positions of the machine, while the ejected blank is designated by reference numeral 111*d*. The feed path at the point of complete reseparation in the deforming machine includes a slight ramp so that the next-following blank is raised to the level of the preceding blank during the next feed cycle without being obstructed by hitting an abutment. Steps 1, 2, 3 and 4 of FIG. 14 are schematic side elevational views in FIG. 14 while step 5 is a schematic plan view.

Figure 15:
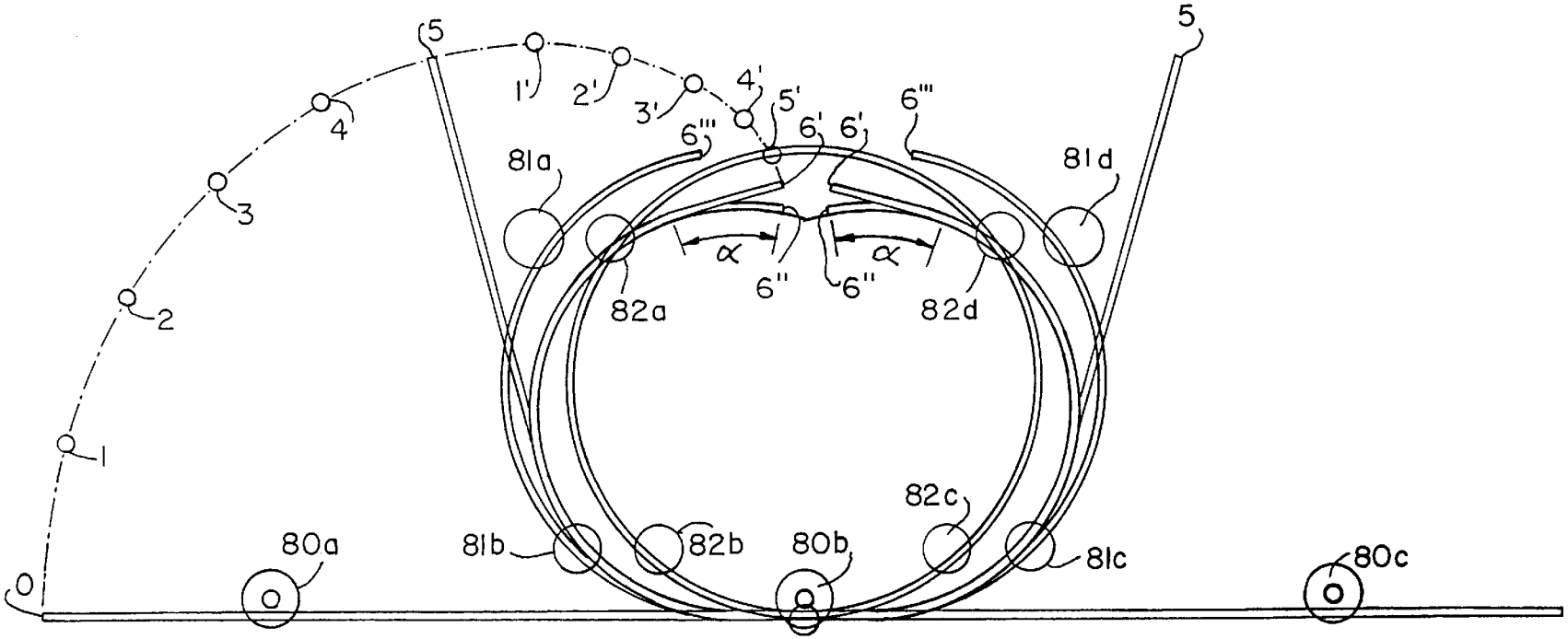
FIG. 15 is a schematic view explanatory of the various stages of deformation in the deformation machine of the invention.

The transverse displacement of the blank illustrated at step 5 in FIG. 14 is realized by three reciprocable finger members 80*a*, 80*b* and 80*c* which displace the separated blank into the first position on the core member 51. In this first position, the blank to form ultimately the compression ring is predeformed so that its end portions conform accurately to the circular configuration needed to permit closing of the puzzle-lock-type mechanical connection. As can be seen in particular in FIGS. 2*a* and 7, the first section 151 of the core member 51 is somewhat oval-shaped with an apple-like configuration. After complete separation of the previously partially reconnected blank and transverse displacement of the separated blank 111*a* by finger members 80*a*, 80*b* and 80*c*, the lower slide members 52 and 53 are moved upwardly substantially simultaneously so that the sections 152 and 153 with their band-engaging deforming surfaces 158 and 159 deform the blank through a path from zero through 1, 2, 3, 4 to the position 5 of FIG. 15. The slide members 60 and 61 with their sections 160 and 161 then engage the substantially rectilinearly upwardly extending band portions with their band-engaging deforming surfaces 168 and 169 to deform the band through positions 1', 2', 3', 4' and 5' into position 6' where the section 170 of the upper slide member 70, upon downward movement, then engages the band with its band-engaging deforming surface 173 to deform the end portions containing the mechanical connection of puzzle lock configurations into position 6". Upon retraction of all slide members, the thus-predeformed blank will snap back into position 6''' as a result of the elasticity of the material and assisted by the L-shaped finger members 190*a* and 190*b* (FIG. 7) spring-supported by springs 192*a* and 192*b* in recesses 191*a* and 191*b* in the core section 151. The shorter legs 194*a* and 194*b* of the finger-like members 190*a* and 190*b* thereby determine the maximum outward projection of these finger-like members. If so desired, the maximum projection of these finger-like members 190*a* and 190*b* may also be adjusted as will be described in connection with FIG. 9.

Figures 8, 9, 10:
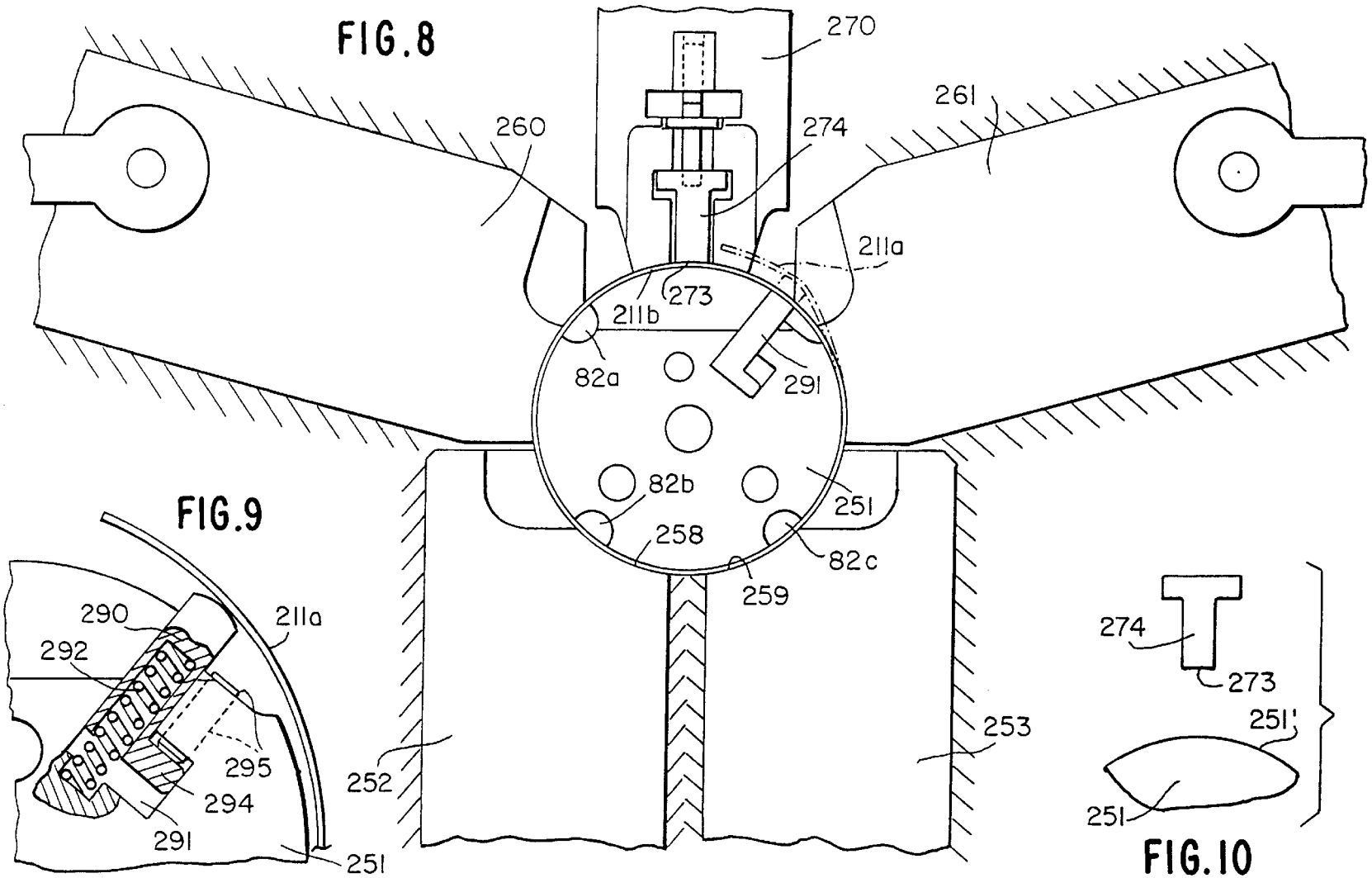
FIG. 8 is a somewhat schematic axial elevational view of the core member and the slide members and their deforming surfaces in position 2 of the bending or deformation machine.
FIG. 9 is an enlarged partial cross-sectional view showing the finger member in the section of the core member of position 2.
FIG. 10 is a somewhat schematic partial view showing the surface of the core member and of the insert member in the upper vertical slide member in position 2 of the core member and upper slide member.
Figures 11, 12:
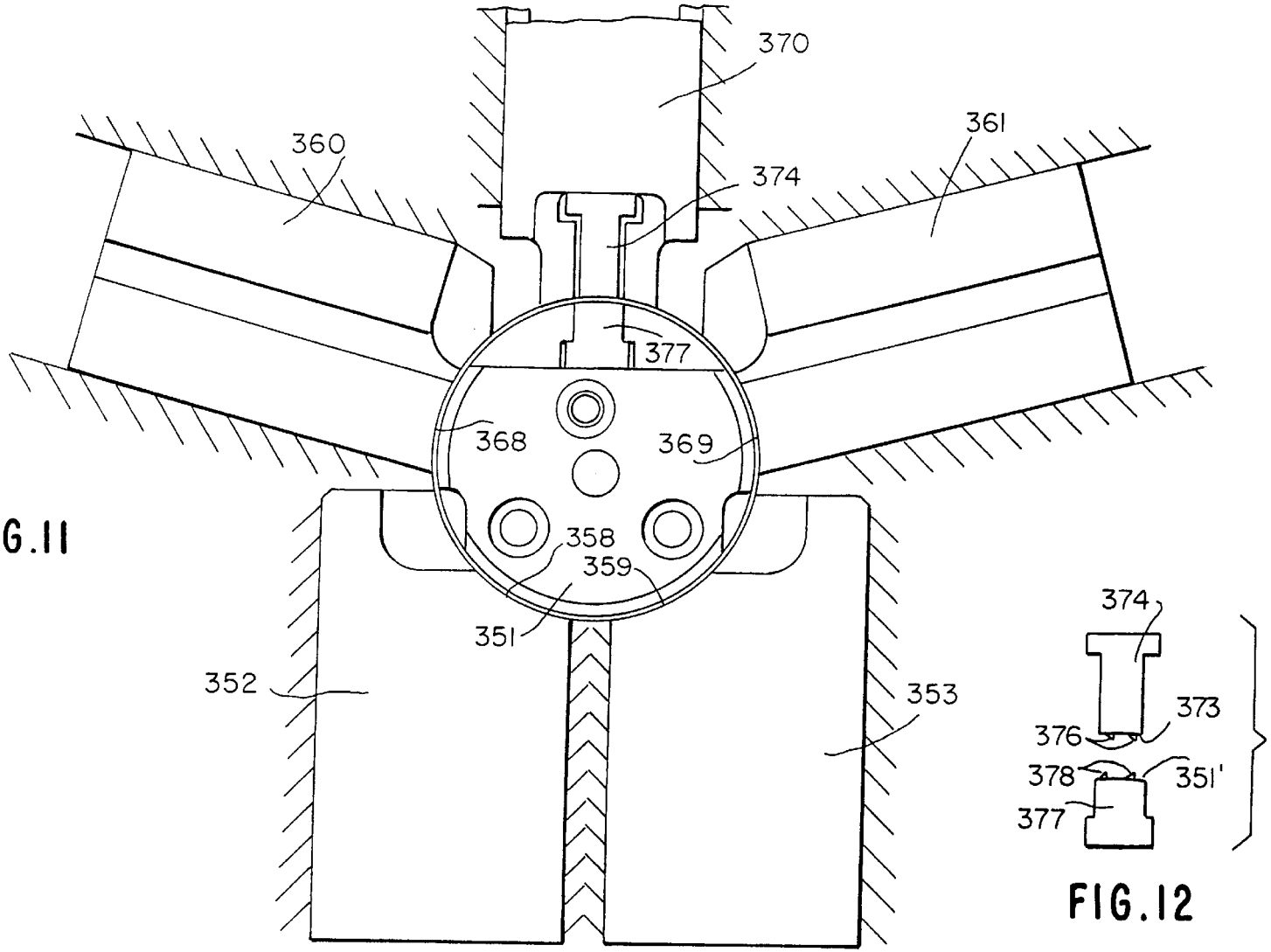
FIG. 11 is a somewhat schematic axial elevational view of the sections of the core member and of the slide members and their deforming surfaces in position 3 of the machine.
FIG. 12 is a somewhat schematic view of the insert members for the core section and for the upper vertical slide member with the deforming projections carrying out the swaging action.

FIG. 2A thereby illustrates the position of the slide members in their retracted position during the beginning of a cycle. Upon completion of a cycle and deformation of the blank in its first position in which its ends 6''' assume the spring-back position shown in FIG. 15, the thus-predeformed blank is then displaced from its first position on the core member 51 by means of reciprocating finger-like members 81*a*, 81*b*, 81*c* and 81*d* into the second axial position on the core member 51. In that position the blank 111*b* is deformed into its circular configuration and the mechanical connection of puzzle-lock configuration is closed. FIG. 8 thereby illustrates the position of the sections 252, 253, 260, 261 and 270 of the slide members 52, 53, 60, 61 and 70 in their extended position. To obtain the overlap necessary to permit closing of the mechanical puzzle-lock-type configuration by means of the section 270 of the upper slide member 70, the inward movement of the slide member 60 into its extended position slightly precedes the movement of the slide member 61. The finger member 290 initially projects out of its recess 291 in order that the female puzzle-lock end portion comes to lie above the male puzzle-lock end portion, whereby the finger member 290 is pushed inwardly against the force of the spring 292 as the section 261 of the slide member 62 reaches its inward extended position. The upper slide member section 270 with its deformation insert 274 thereby closes the puzzle lock during its downward movement to complete the deformation and closing of the compression ring. As the slide members 52, 53, 60, 61 and 70 again are retracted during completion of the second cycle of operation, the thus-deformed and closed compression ring is moved from its second position into the third position of the compression ring 111*c* by finger members 82*a,* 82*b,* 82*c* and 82*d.* This displacement of the deformed and closed compression ring from position 2 to position 3 at the same time ejects the compression ring 111*d* previously held in position 3 after being subjected to the swaging action in position 3, to be described more fully hereinafter.

In position 3 (FIG. 11), the closed ring 111*c* is subjected to a swaging action by means of the small tooth-like projections 376 on insert member 374 of the section 370 of the upper slide member 70 and by means of small tooth-like projections 378 on insert member 377 inserted into the core section 351. These teeth are thereby so located that a swaging action occurs in the area of the transversely extending abutment edges 411, 412 and 439 of the mechanical puzzle-lock-type connection (FIG. 5) within the areas indicated by the dash lines 411, 412 and 410. This swaging action, as described in my copending application, the subject matter of which is incorporated herein by reference, significantly improves the holding ability of the compression ring.

Figure 13:
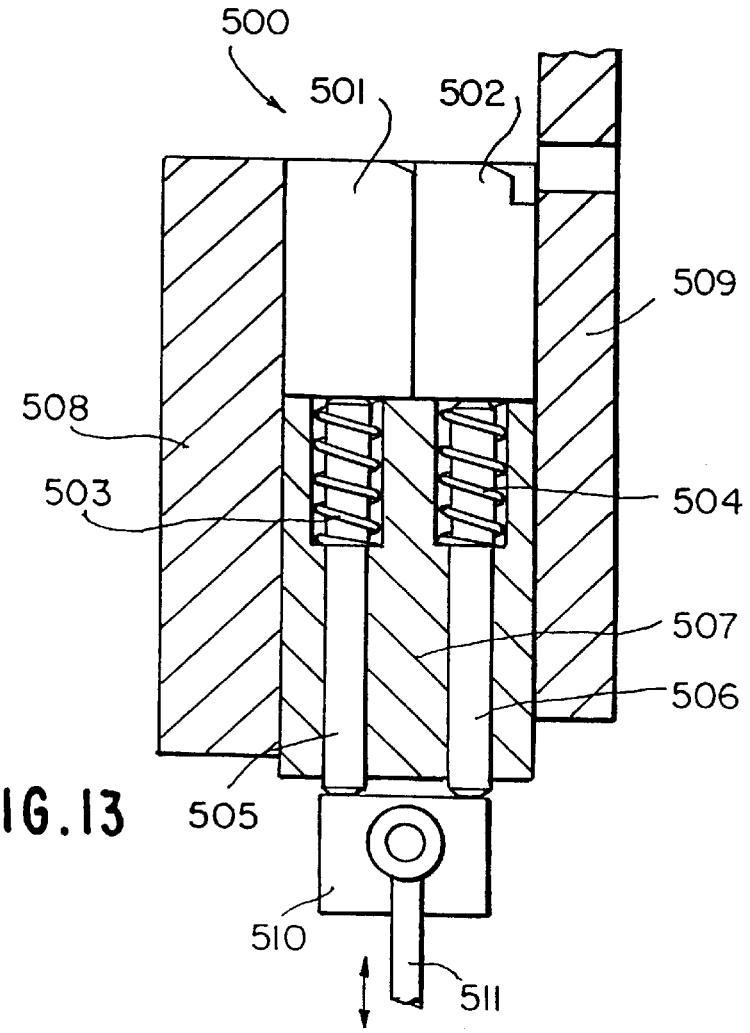
FIG. 13 is a somewhat schematic view of the device for holding the band in the same position relative to the core member during deformation.

FIG. 13 illustrates a device generally designated by reference numeral 500 for holding the blank in its predetermined position on the core member 51 so that the swaging action always takes place in the proper positions of a mechanical puzzle-lock-type connection. The device 500 is thereby arranged in the space between lower slide members 52 and 53 and their guide parts, FIG. 13 being a cross-sectional view taken in the axial direction. Two pressure members 501 and 502 extending upwardly against the bottom surface of the blank ultimately forming the compression ring are spring-loaded by means of springs 503 and 504 which are accommodated within recesses of housing block 507 and surrounding plunger members 505 and 506. Guide members 508 and 509 thereby guide the pressure members 501 and 502 and parts associated therewith in the upward and downward movement. An abutment member 510 is in engagement with the lower ends of the plunger members 505 and 506 to further increase the pressure exerted by the pressure members 501 and 502 on the bottom of the blank forming the compression ring over and above the force normally exerted by springs 503 and 504. The abutment member 510 is thereby connected by connecting member 511 to any device causing upward and downward movement of the abutment member 510. In a preferred embodiment, the connecting member 511 is connected with a piston rod of a pneumatic piston unit (not shown) which is so actuated that the connecting member 511 is moved upwardly into the position shown in FIG. 13 during the deformation operations in a given cycle to very firmly hold the blank forming the compression ring in its predetermined position, during such deformation operations. During the part of each cycle in which the clamping rings are displaced by finger members 81*a* through 81*d* and 82*a* through 82*b,* the abutment member 510 is moved downwardly so as to reduce the pressure exerted by the pressure members 501 and 502 and thereby allow axial displacement of the compression rings though without circumferential movement. However, the springs 503 and 504 are so dimensioned that they hold the compression ring in proper position on the core member 51 yet permit axial movement of the compression rings as required for each operation.

In one typical non-limitative embodiment of a machine of this invention, used for making compression rings with an inner diametric dimension of 79.6 mm. and a band thickness of 1.4 mm., the deformation surfaces of the slide members engaging with the compression ring blank are as follows. Core section 151 has a length of 92 mm. and a height of 70 mm. The surfaces 158 and 159 of sections 152 and 153 of the lower slide members 52 and 53 have a radius of curvature of 36.4 mm. The surfaces 168 and 169 of sections 160 and 161 of slide members 60 and 61 have a radius of curvature of 36.4 mm. The radius of curvature of the curved portion of surface 173 are each 36.4 mm. while the corresponding surfaces on core section 151 have a radius of curvature of 35 mm.

The diametric dimension of core section 251 of core member 51 is 79.4 mm., the curvature 268 and 269 of sections 260 and 261 of slide members 60 and 61 have a radius of curvature of 41.1 mm. and the insert member 274 in section 270 of the upper slide member 70 has a surface 273 with a radius of curvature also of 41.1 mm.

Figure 16:
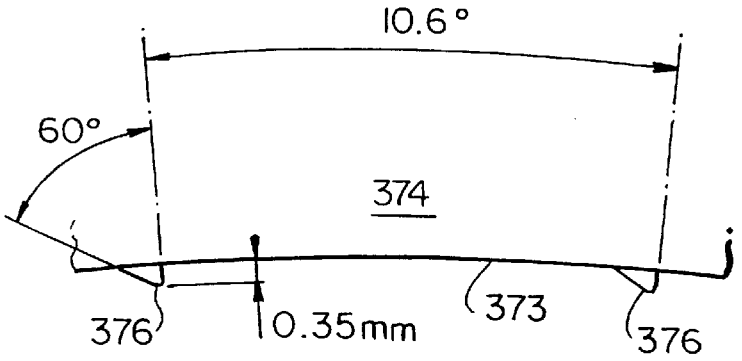
FIG. 16 is a partial view, on an enlarged scale, showing the shape of the swaging teeth on the insert member for the section of the upper slide member in position 3.

The section 351 of core member 51 (FIG. 11) has a diametric dimension again of 79.4 mm. while the surfaces 358 and 359 of sections 352 and 353 of slide members 52 and 53 have again a radius of curvature of 41.1 mm. The surfaces 368 and 369 of sections 360 and 361 of slide members 60 and 61 also have a radius of curvature of 41.1 mm. while the small tooth-like projections 376 on insert member 374 in section 370 of slide member 70, more fully shown in FIG. 16, have a height of 0.35 mm. and subtending an angle of 60° as also shown in FIG. 16. These tooth-like members 376 are thereby spaced a total of 10.6° in the cicumferential direction. The small tooth-like projections 378 on insert member 377 are of similar configuration as the tooth-like projections 376, i.e., have a height of 0.35 mm. and subtending an angle of 60° spaced 10.6° in the circumferential direction.

The predeforming of the compression ring in position 1 to facilitate closing of the mechanical connection requires a different handling with compression rings of small diameter because in that case the tapering effects due to the small radius of curvature in the male and female parts of a puzzle-lock-type connection assume greater significance which make it difficult to close the connection due to the smaller openings along the inner circumferential surface of the band portion. In that case, it may be desirable to predeform the end sections containing a mechanical connection of the puzzle-lock configurations in position 1 so as to be flat, close the flat puzzle-lock configurations in position 2 and then deform the closed compression ring into the desired circular configuration. This may be done, for example, in another stage so that complete manufacture would require four cycles of operation with four positions. However, good results have also been obtained in that case by softening the material in the areas of the male and female puzzle-lock configurations in the end portions of the compression ring blank by subjecting the same to a heat treatment of about 400° C. By thus softening the material, closing of the mechanical connection of a puzzle-lock configuration is facilitated by the softer material which, however, is again work-hardened by the actual closing of the mechanical connection so that only the three stages of operations in the three positions described hereinabove are sufficient.

The machine of this invention is very efficient because by merely interchanging the sections of the various slide members, it is possible to manufacture with the same equipment compression rings of different diametric dimensions. Furthermore, the speed at which the machine can be operated is high, permitting the ready production of fifty-five compression rings per minute.

All slide members are mechanically actuated by mechanically driven cams while the slide members may be mounted by means of roller bearings to assure frictionless slide movement in their reciprocating movements during a cycle of operation. The different sections of the slide members 52, 53, 60, 61 and of the core member 50 are also provided with such surfaces as to permit axial extension of the finger members 81*a*–81*d* and 82*a*–82*d*, for example, as shown by part-circular recesses and circular openings in the core section 150 of FIG. 7 and the appropriately shaped end surfaces in slide member 52, 53 and 60, 61. If the swaging action is not needed or not desired, the machine as described above may also use only two axial positions instead of three. The slide members may also be actuated by other means other than mechanical cam operation. However, the coordination of the various movements of the slide members and their timing is best achieved by appropriate design of the cam members and synchronous operation thereof, for example, driven from a single electric motor by way of sprocket-and-chain drives.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed and second feed means for feeding a predetermined blank in said axial direction from the first position to a second position corresponding to the second position on said core means in which the blank is deformed into substantially final form after said puzzle-lock connecting means are closed, wherein said slide members include at least one lower slide member reciprocable upwardly toward said core-like means, at least two lateral slide members reciprocable from substantially opposite sides toward said core-like means, and at least one upper slide member reciprocable downwardly toward said core-like means, further comprising means for holding the blank in predetermined position relative to the core-like means during all operating cycles by applying holding pressure on the blank within the area of said at least one lower slide member, wherein said holding means is operable to apply a lesser pressure during operating periods of said feed means and a higher pressure during periods of deformation by said slide members.

2. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed and second feed means for feeding a predetermined blank in said axial direction from the first position to a second position corresponding to the second position on said core means in which the blank is deformed into substantially final form after said connecting means are closed, wherein during a given cycle, said actuating means is operable to displace at first at least one lower slide member toward said core-like means, then to displace one of two lateral slide members towards said one core-like means after aid at least one lower slide member has reached its extended position, thereafter to displace the other of said lateral slide members toward said core-like means before said one lateral slide member has reached its extended position, and thereupon to displace said at least one upper slide member toward said core-like means after the two lateral slide members have reached their extended position.

3. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed and second feed means for feeding a predetermined blank in said axial direction from the first position to a second position corresponding to the second position on said core means in which the blank is deformed into substantially final form after said connecting means are closed, wherein the external surface means corresponding to the first position on said core-like means includes two spring-supported finger-like means extending in the generally lateral direction to assist in pre-deforming said blank, wherein the external surface means corresponding to the second position on said core-like means includes a spring-supported finger-like means extending in a direction between the downward direction of the upper slide member and the inward direction of the other lateral slide member to cause overlap of the two end areas of the mechanical connecting means, and wherein the maximum projection of at least said last-mentioned finger-like means is adjustable.

4. A machine according to claim 1, wherein two spaced lower slide members are provided on opposite sides of the lowest point on said core-like means, and wherein said holding means is located in the space between said two lower slide members and extends axially substantially over the several positions.

5. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed, and second feed means for feeding a predetermined blank in said axial direction from the first position to a second position corresponding to the second position on said core means in which the blank is deformed into substantially final form after said connecting means are closed, wherein the external surface means of the core-like means in said first position is of such shape as to predeform the free ends of a blank to conform to the shape necessary to enable closing of the mechanical connecting means in the second position.

6. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed, and second feed means for feeding a predetermined blank in said axial direction from the first position to a second position corresponding to the second position on said core means in which the blank is deformed into substantially final form after said connecting means are closed, wherein the external surface means of the core-like means in said second position is generally circular and includes a finger-like projection means to cause initial overlap of the free ends of the blank containing the mechanical connecting means during initial deformation in said second position until the mechanical connecting means are closed by further deformation in said second position by downward movement of one of said slide members from above.

7. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed, and second feed means for feeding a predetermined blank in said axial direction from the first position to a second position corresponding to the second position on said core means in which the blank is deformed into substantially final form after said connecting means are closed, further comprising means for feeding the thus-closed and deformed blank to a third position corresponding to a third position on said core-like means in which the compression ring is subjected to a swaging action within predetermined areas of joints formed in the mechanical connecting means, and means for ejecting the finished compression ring from the third position.

8. A machine for automatically manufacturing compression rings from flat blanks provided with complementary mechanical connecting means at the free ends thereof, which comprises, at a deformation station, core-like means having several external surface means corresponding to several successive positions in an axial direction substantially transverse to the longitudinal direction of a blank, a plurality of slide members for deforming the blank, each slide member having several band-engaging end surface means at the free ends thereof corresponding in number to the number of positions on said core means, actuating means for actuating said slide members in predetermined sequence during an operation cycle, first feed means for feeding a flat blank in said axial direction to a first position corresponding to the first position on said core means in which the blank is predeformed into ring-like shape facilitating closing of the mechanical connecting means in a second position, and second feed means for feeding a predetermined blank in said axial direction from the first position to said second position corresponding to the second position on said core means in which the blank is deformed into substantially final form after said connecting means are closed.

9. A machine according to claim 8, wherein successive positions of the external surface means on said core means have an axial length corresponding substantially to the width of the blank.

10. A machine according to claim 8, wherein said slide members are operable to deform the blank from below, from the sides and from above.

11. A machine according to claim 5, wherein the external surface means of the core-like means in said first position is slightly oval to such an extent as to avoid overlap of the free ends of the blank.

12. A machine according to claim 11, wherein the external surface means of the core-like means in said first position include finger-like projection means to assist in realizing the predeformed oval shape.

13. A machine according to claim 8, wherein two slide members are provided actuatable toward the core means in a generally upward direction, two further slide members are provided which move toward the core means from substantially opposite sides thereof, and a downwardly actuatable slide member is provided actuatable toward the core means in a generally downward direction.

14. A machine according to claim 8, further comprising support means engaging the blank from below to keep the blank in the same height position in relation to on the core means as the blank is displaced through and deformed in the several positions.

15. A machine according to claim 8, further comprising a band material supply station, a stamping station for stamping out the complementary mechanical connecting means and to form blanks, continuous feed means for continuously feeding uninterrupted band material from said supply station to a point along the path to said stamping station, and intermittently operable feed means to feed blanks from said point to said stamping station.

16. A machine according to claim 15, further comprising control means to correlate the speed of said continuous feed means with the speed of said intermittently operable feed means.

17. A machine according to claim 16, wherein a reel of band material is adapted to be positively driven at the supply station to decoil the band material from said reel, and the speed of the driven reel is operable to be adjusted by said control means.

18. A machine according to claim 15, wherein said stamping station includes stamping-die means having matrix means and stamping-die punch means for each end portion of two adjacent blanks for stamping out complementary mechanical connecting means in such a manner that the two adjacent blanks are initially completely severed and disengaged from one another and after completion of a cut are then again partially reconnected to enable feed of the blanks from the stamping station to the deformation station by said intermittently operable feed means, whereby the partially reconnected blanks are again disconnected by a disconnecting means prior to transverse movement by said first feed means.

19. A machine according to claim 7, wherein the external surface means of the core-like means in said first position is of such non-circular shape as to deform the free ends of a blank to conform to the shape necessary to enable closing of the mechanical connecting means in the second position.

20. A machine according to claim 19, wherein the external surface means of the core-like means in said second position are generally circular and include a finger-like, spring-supported projection means to cause initial overlap of the free ends of the blank containing the mechanical connecting means during initial deformation until the mechanical connecting means is closed by further deformation in said second position by downward movement of one of said slide members from above.

21. A machine according to claim 7, wherein the first feed means includes rod-like members actuatable in the axial direction for engagement with the flat blank, wherein said second feed means includes further rod-like members actuatable in the axial direction for engagement with the predeformed blank in the first position and wherein said further feed means includes rod-like members for engagement with the deformed blank in the second position while said ejecting means is formed by movement of a blank from the second to the third position.

22. A machine according to claim 7, wherein successive positions of the external surface means on said core-like means have an axial length corresponding substantially to the width of the blank.

23. A machine according to claim 22, wherein two upwardly actuatable slide members are provided actuatable toward the core-like means in a generally upward direction, two further slide members are provided which move toward the core means from substantially opposite sides thereof, and a downwardly actuatable slide member is provided actuatable toward the core means in a generally downward direction, and wherein each slide member is provided with separate external surface means corresponding to the intended deformation by the respective slide member in the corresponding position.

24. A machine according to claim 23, further comprising spring-loaded support means engaging the blank from below to keep the blank in the same position on the core means as the blank is displaced through and deformed in the several positions, said spring-loaded support means being additionally engageable to increase the support force during deformation periods of the slide members.

25. A machine according to claim 7, wherein the feed means are actuated upon substantial retraction of the slide members at least near completion of an operating cycle involving to-and-fro movements of the slide members.

26. A machine according to claim 8, wherein during normal operation, a blank is present in each of the several positions and each slide member engages with each of its engaging surface means a respective one of the blanks.

27. A machine according to claim 7, wherein the end surface means corresponding to the third position on one of said slide members and the external surface means corresponding to the third position on said core-like means are provided with small material-displacing tooth-like means to carry out in the third position the swaging action in certain areas of the joint formed by the closed mechanical connecting means.

28. A machine according to claim 27, wherein said certain areas are located in areas of transversely extending abutment surfaces of the mechanical connecting means.

29. A machine according to claim 8, wherein each slide member is composed of a number of axially arranged sections each provided with its end surface means and fixedly connected with each other to move in unison during each cycle of operation, and wherein said core-like means is composed of a number of axially arranged sections, each provided with its own external surface means and fixedly connected with each other.

30. A machine according to claim 18, wherein said initial complete disengagement and subsequent partial reconnection is realized by spring support means of the punch means for the leading part of the complementary puzzle-lock connecting means and by spring support means of the matrix means for the trailing part of the complementary puzzle-lock connecting means.

* * * * *